US005456612A

United States Patent [19]

van Grunsven et al.

[11] Patent Number: 5,456,612

[45] Date of Patent: Oct. 10, 1995

[54] HIGH DENSITY ELECTRICAL CONNECTOR WITH INTEGRAL SELF SHUNT FEATURE

[75] Inventors: Johannes M. P. A. van Grunsven, JE s'-Hertogenbosch; Johannes W. A. J. van Lokven, HJ Heesch, both of Netherlands

[73] Assignee: The Whitaker Corporation, Wilmington, Del.

[21] Appl. No.: 158,176

[22] Filed: Nov. 23, 1993

Related U.S. Application Data

[63] Continuation of Ser. No. 28,027, Mar. 8, 1993, abandoned.

[30] Foreign Application Priority Data

Mar. 3, 1992 [GB] United Kingdom ..... 9205045

[51] Int. Cl.[6] ..... H01R 29/00

[52] U.S. Cl. ..... 439/188; 439/513

[58] Field of Search ..... 439/188, 510–513; 200/51.09, 51.1

[56] References Cited

U.S. PATENT DOCUMENTS

| | | | |
|---|---|---|---|
| 4,256,936 | 3/1981 | Lancaster | 200/51.1 |
| 4,988,307 | 1/1991 | Muzslay | 200/51.1 |
| 5,071,362 | 12/1991 | Martens et al. | 439/188 |
| 5,098,306 | 3/1992 | Noschese et al. | 439/188 |

FOREIGN PATENT DOCUMENTS

| | | |
|---|---|---|
| 0499967 | 8/1992 | European Pat. Off. . |
| 0555653 | 1/1993 | European Pat. Off. . |
| 2733157 | 1/1979 | Germany . |
| 2238672 | 6/1991 | United Kingdom . |
| WO86/00474 | 1/1986 | WIPO . |
| WO88/09070 | 11/1988 | WIPO . |

*Primary Examiner*—Gary F. Paumen
*Assistant Examiner*—Hien D. Vu
*Attorney, Agent, or Firm*—Eric J. Groen; Driscoll A. Nina

[57] ABSTRACT

An electrical connector assembly comprises a header having a plurality of pins, the pin header being interconnectable with a receptacle header having a plurality of receptacle contacts. A selected pair of adjacent passageways has a space between the adjacent passageways and these selected passageways contain shunting terminals positioned therein. The shunting contacts include opposed contact portions for making contact with the pins and have laterally extending shunt contact portions receivable in the space and which is profiled for making contact with a like shunt contact in the adjacent cavity. When the receptacle connector is in an unmated position, the laterally extending shunt contacts and adjacent passageways are preloaded into engagement with one another to shunt the terminals together, and when the receptacle connector is in a mated condition, the pins make contact with the opposed contact portions thereby moving the shunt contacts in opposite directions thereby placing the receptacle connector in an unshunted condition.

20 Claims, 5 Drawing Sheets

HIGH DENSITY ELECTRICAL CONNECTOR WITH INTEGRAL SELF SHUNT FEATURE

This application is a Continuation of application Ser. No. 08/028,027 filed Mar. 8, 1993, now abandoned.

BACKGROUND OF THE INVENTION

1. Field of the Invention

The invention relates to an electrical receptacle having a plurality of opposed contact portions where some of the adjacent contacts are self shunted.

2. Summary of the Prior Art

It is known in high density bus connectors to short elected adjacent contacts. One of the known connectors is shown in U.S. Pat. No. 5,071,362 and includes an inverted V-shaped spring which extends in through an upper passage to be positioned adjacent to side edges of the receptacle contacts. The V-shaped spring contact has two legs, each of which extend into adjacent terminal passageways and are spring loaded against a terminal in the passageway when in the unmated position. Each of the legs of the V-shaped spring include a plastic "button" which extends between the receptacle leaf contacts, such that upon insertion of the mating pin, the pin contacts the button and pushes the leaf contact away from the terminals.

One of the shortcomings of the known connector is that the cost of the connector is increased by this design. As the shunt spring is a discrete item, the spring must be manufactured from a spring material, and formed with the plastic buttons, thereby increasing the cost of the raw material. Furthermore, these shunt springs must be inserted between adjacent passages of contacts without damaging the receptacle contacts or the shunt spring.

Furthermore, the centerline spacing of such connectors is a set dimension, thus the side-to-side spacing between adjacent contacts is fixed, leaving little extra room for the shunt spring. For this reason the shunt spring tends to be formed from a thin stock material which can be easily inserted in the spacing between the adjacent contacts. With such a thin spring, the resiliency of the spring could be overcome to the point of being plastically deformed, and the spring could be in a non-contacting relation with the receptacle contacts even when in an unmated position.

Moreover, the design of the known connector is such that the shunting capability is dependent upon a small plastic button, which can wear, or the spring legs could bend, to the point where the pin is contacting the lower edge of the spring leg, even when the two connectors are freely mated together.

It is an object of the invention then to provide for an easily manufacturable, yet highly reliable design.

It is a further object of the invention to provide for an electrical connector where there are no discrete shunting springs.

SUMMARY OF THE INVENTION

The objects of the invention were accomplished by providing a receptacle header comprising an insulating housing having a plurality of terminal passageways with a like plurality of electrical contacts positioned therein. The contacts have two opposed contact portions profiled for mating with pin portions of a mating connection and the connector having a shunt mechanism to shunt a selected pair of contacts when in the unmated condition and to be taken out of the shunted condition when in a mated condition with the mating pin portions. The connector is characterized in that a space is positioned between the selected pair of adjacent passageways, at least in the region of the opposed contact portions, and said shunting mechanism comprises a shunt contact extending laterally from opposite contact portions towards each other, the shunt contacts being preloaded to shunt the adjacent terminals when in an unmated position.

BRIEF DESCRIPTION OF THE DRAWINGS

FIG. 6 is a view similar to that of FIG. 1, showing the pin and receptacle connectors fully mated.

DETAILED DESCRIPTION OF THE PREFERRED EMBODIMENT

Figure 1:
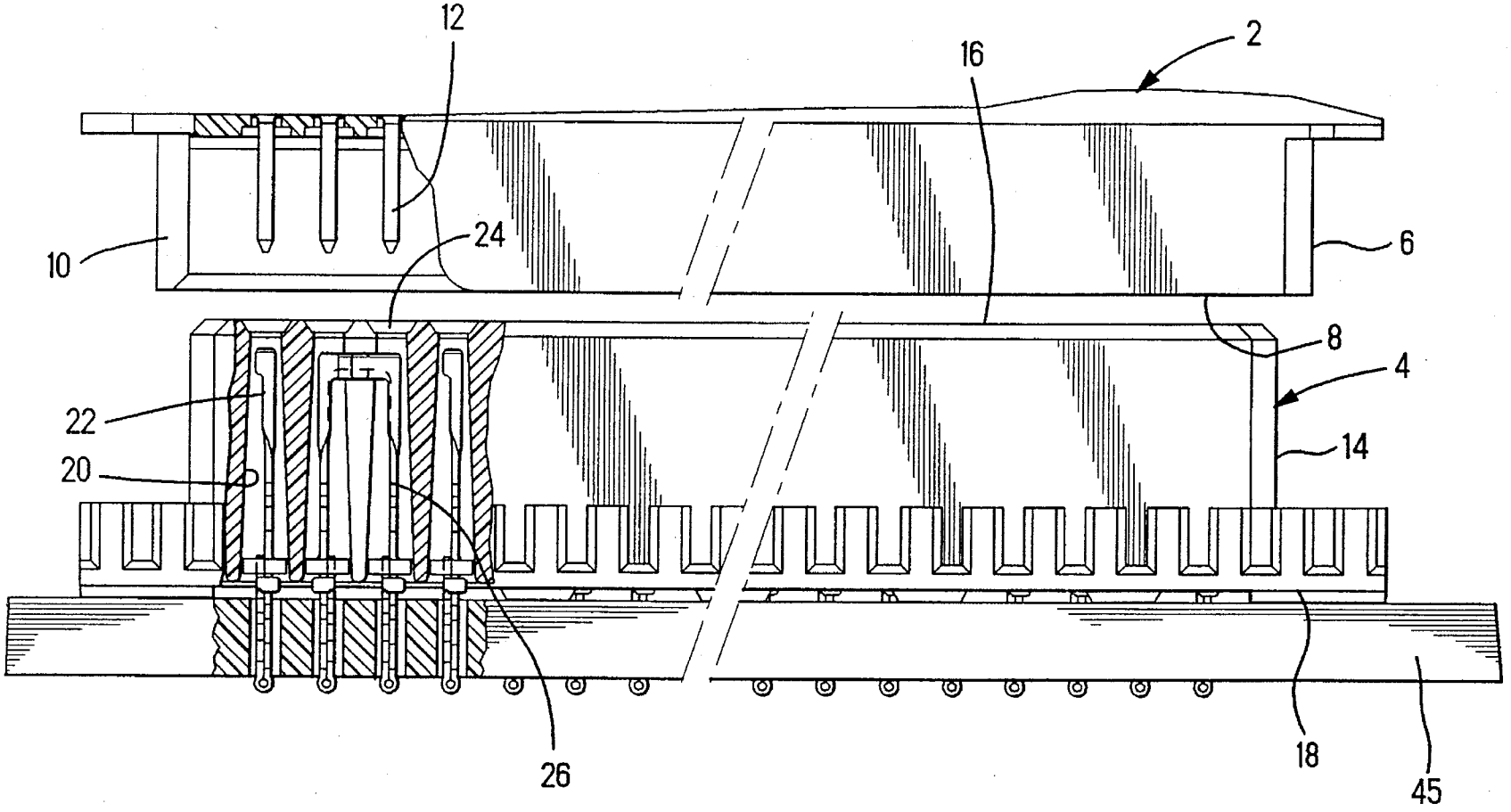
FIG. 1 is a front plan view of a pin header positioned above the inventive receptacle assembly.
Figure 4:
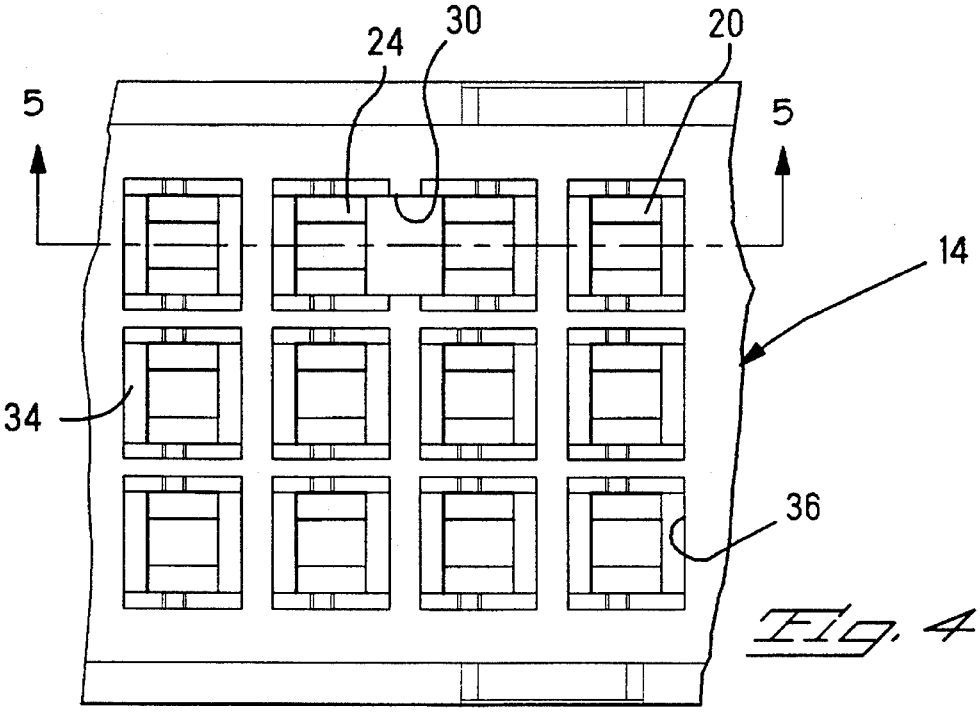
FIG. 4 is a bottom view of the housing of FIG. 1.

With reference first to FIG. 1, an electrical connector assembly is shown comprised of a pin header 2 and an electrical receptacle connector 4. The pin header contains an electrically insulating housing 6 having a front mating face 8, formed by an encircling shroud 10. A plurality of pin terminals 12 are inserted in the pin header 2. As shown in FIG. 1, the receptacle connector 4 has an insulating housing 14 having an upper mating face 16, and a lower face 18 for mounting adjacent to a printed circuit board. The connector housing 14 contains a plurality of passageways 20 having electrical terminals 22 therein. In addition, the connector has selected passageways 24 having self shorting terminals 26 therein. With reference now to FIG. 4, the housing 14 will be described in greater detail.

Figure 5:
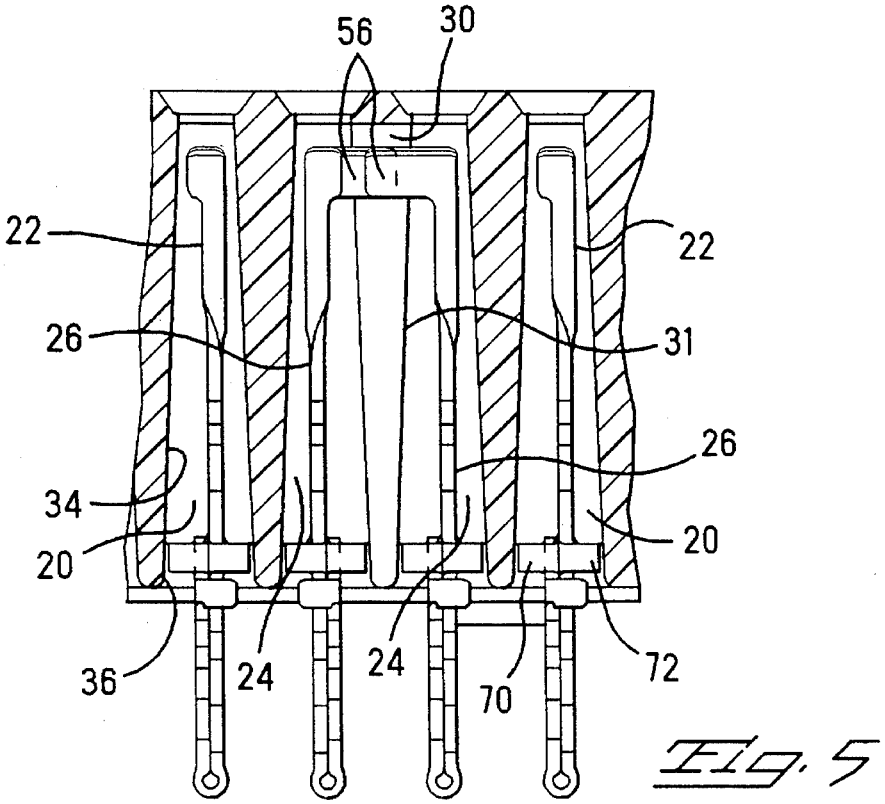
FIG. 5 is a cross-sectional view through lines 5—5 of FIG. 4.
Figure 5:
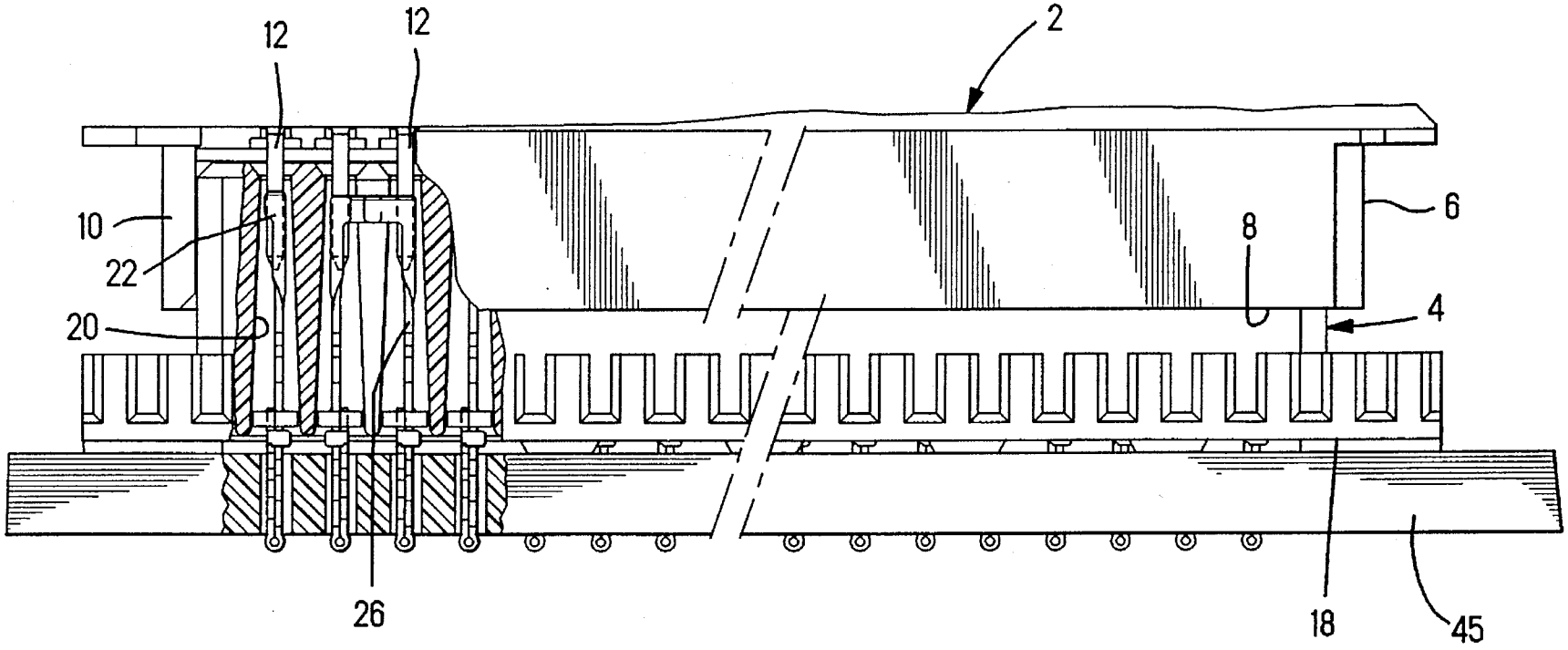

The housing 14 includes passageways 24 for selected terminals, where the adjacent passageways share an opening 30 transversely through lateral wall portions 31 of the passageways for communication therebetween. As shown in FIG. 5, the passageways 20 include inclined walls 34, narrowing upwardly, forming a lower terminal receiving mouth 36.

Figure 3:
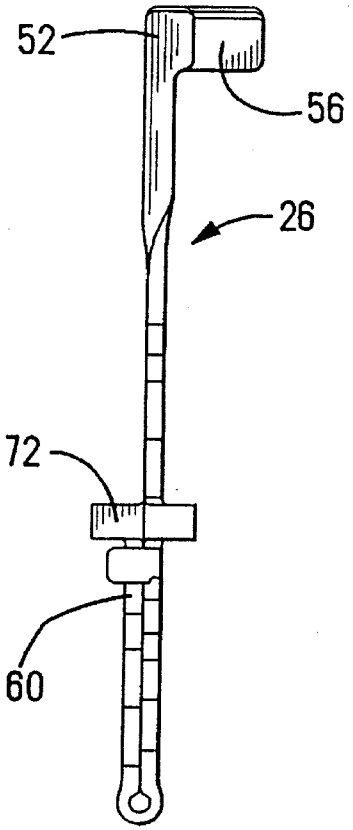
FIG. 3 is a side view of the terminal of FIG. 2.
Figure 2:
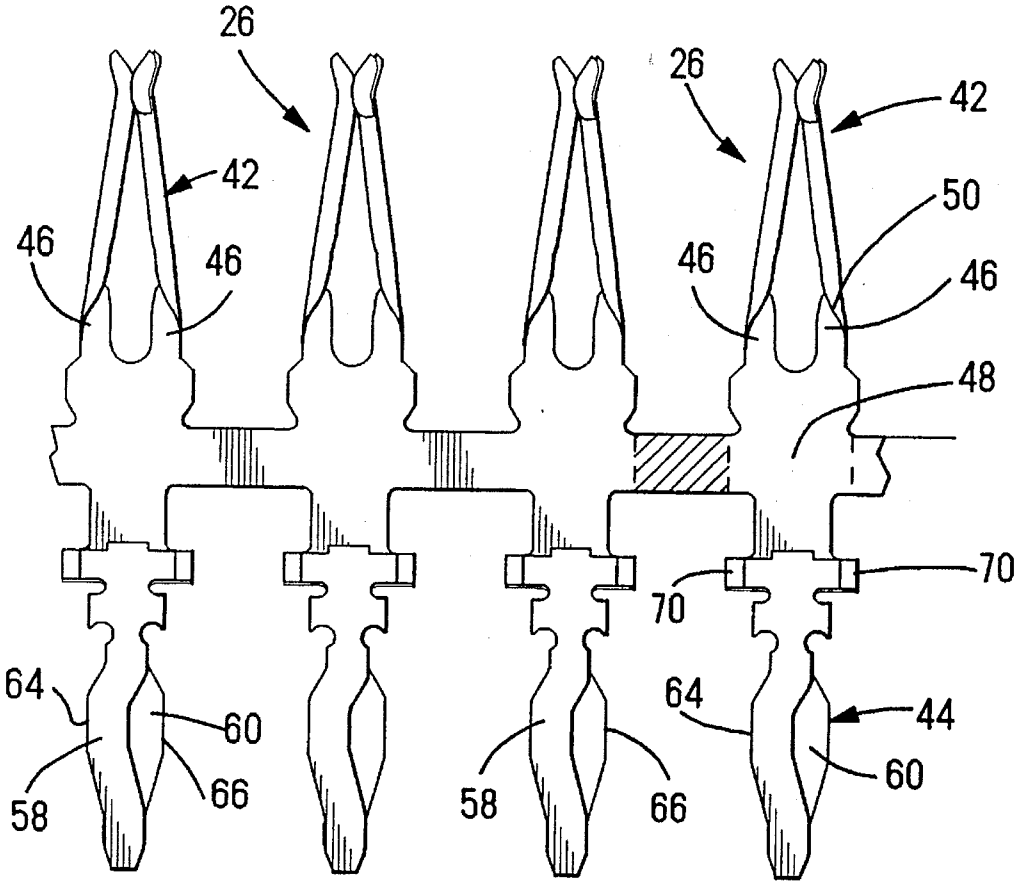
FIG. 2 is a side plan view of several of the selfshunting electrical terminals of the present invention.
Figure 8:
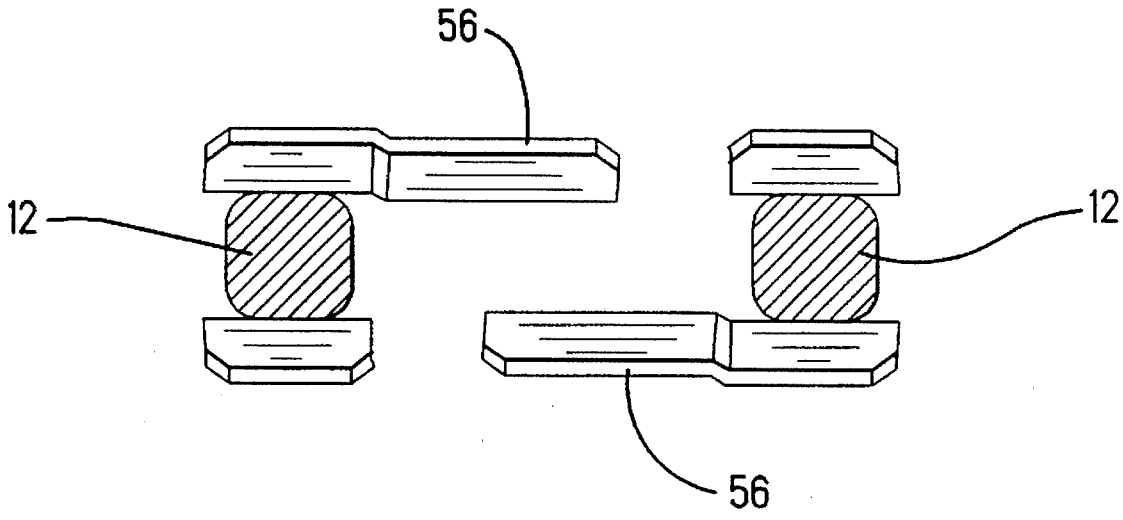

With reference now to FIGS. 2–3, the terminals 26 include a receptacle contact portion 42 and a compliant portion 44 for interconnection to a printed circuit board 45 (FIG. 1). The receptacle portion 42 is formed from two arm portions 46 upstanding from a base portion 48, the arms 46 being twisted at 50 to form two opposed contact portions 52. One of the two contact portions 52 includes an integral shunting arm 56 extending laterally thereof, and which is somewhat offset from the plane of associated contact arm 52, and shifted towards the opposite contact arm, as best shown in FIG. 8.

The compliant pin portion is formed by two stamped sections 58 and 60 which are folded about an end 62 thereof, to form staggered contact surfaces 64 and 66. Two arms 70 extend from portion 58, while two sections 72 extend from the portion 60, as best seen in FIG. 3. As shown in FIG. 6, these arms 70 and 72 help retain the terminals in their associated passageways.

Figure 7:
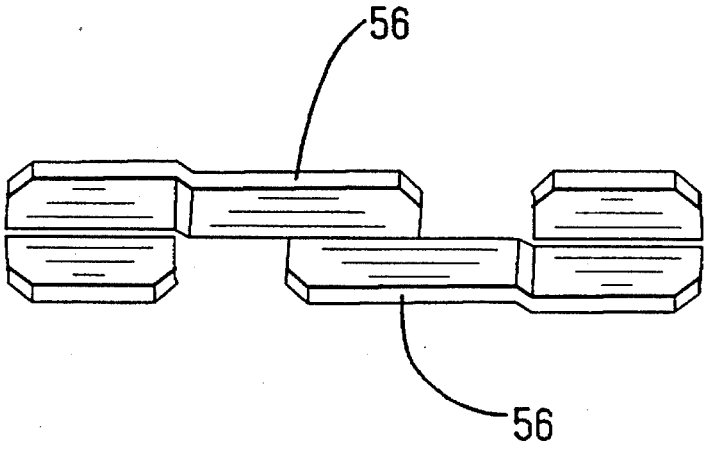
FIGS. 7 and 8 are diagrammatical views of the terminals in the shunted and unshunted condition, respectively.

When adjacent selected terminals are to be shunted, two terminals 26 are positioned in adjacent side-by-side cavities with the shunt portions 56 overlapping into the opening 30, and positioned in a contacting relationship. It should be noted from FIG. 5 that the two shunted terminals are identical, one being rotated 180° relative to the other. With reference now to FIGS. 7 and 8, the adjacent contacts are shown in shunted and unshunted condition, respectively. As shown in FIG. 7, the two contacts are shown in their free state, when the two shunt portions are resiliently biased against each other, thereby shunting the two contacts together. As mentioned above, the contact portion 56 is staggered relative to the remainder of the contact portion, such that when in the unshunted condition, their is always some preload on the shunt terminals 56. With respect now to FIG. 8, the shunt terminals are shown being spread apart in opposite directions by the pins 12, so that a spacing exists between the shunt contacts 56.

Advantageously then, the connector is formed by a small integral inclusion on the contact arm only, adding very little in cost. Furthermore all the shunting terminals are identical. Finally, the resiliency in the terminal itself, shelf shorts the adjacent contact.

We claim:

1. An electrical receptacle header comprising an insulating housing having a plurality of discrete terminal passageways with a like plurality of electrical contacts positioned therein, said contacts having two opposed contact portions profiled for mating with pin portions of a mating connector, said header having a shunting mechanism which shunts a selected pair of contacts when in an unmated condition of the connector and which is unshunted when the connector is in a mated condition with the mating pin portions, where some of the contacts of the connector are not selected and have no shunting mechanism, wherein at least one of the opposed contact portions of one of the plurality of electrical contacts has a first shunt contact extending integrally and laterally therefrom, said first shunt contact being movable towards and away from a second shunt contact commoned to another one of contacts, upon respective withdrawal and insertion of a pin contact into the opposed contact portions of the one or the other of the plurality of electrical contacts.

2. The electrical connector of claim 1, wherein said second shunt contact is also comprised on a lateral extension from one of said opposed contact portions.

3. The electrical connector of claim 2, wherein said first and second shunt contacts extend from diagonally opposite sides of opposing contacts in adjacent passageways, said housing having a communication between said adjacent passageways, with said first and second shunt contacts extending into said communication, in laterally overlapping relation with each other.

4. The electrical connector receptacle of claim 1, wherein said first shunt contact is profiled as a flag terminal portion.

5. The electrical connector receptacle of claim 4, characterized in that said flag terminal portion is stepped towards said opposed contact portion of the selected terminal.

6. The electrical receptacle header of claim 1, wherein said second shunt contact is integrally formed with the other contact of the selected pair.

7. The electrical receptacle header of claim 1, wherein said selected pairs are in adjacent terminal passageways.

8. The electrical receptacle header of claim 7, wherein said second shunt contact is integrally formed with the other contact of the selected pair.

9. The electrical receptacle header of claim 8, wherein the second shunt contact extends laterally from the other contact.

10. A high density electrical connector comprising an insulating housing having a plurality of discrete terminal receiving passageways with a like plurality of electrical contacts positioned therein, each of said contacts having two opposed contact portions profiled for mating with a pin portion of a mating connector, said electrical connector having a shunting mechanism which shunts a selected pair of contacts when in an unmated condition of the connector and which allows the selected pair of contacts to be unshunted when the connector is assembled with the mating connector, wherein some of the contacts of the connector are not selected and have no shunting mechanism, wherein the housing has a communication opening between said selected pair, and said shunt mechanism comprises a shunt contact extending into said communication opening from each contact of said pair and said shunt contacts being disengaged in an unshunted condition due to at least one pin portion being inserted into one of said contacts of said pair, and electrically engaging each other in a shunted condition when the at least one pin portion is not inserted into one of said contacts of said pair.

11. The electrical connector of claim 10, wherein said space is through a communication opening adjacent said cavities in said housing.

12. The electrical connector of claim 10, wherein said shunt contacts are defined by a shunted arm extending laterally from a side edge of opposite contact portions in adjacent cavities, providing two overlapping shunting arms which contact each other when no pin portion is inserted in the contact portions.

13. The electrical connector of claim 10, wherein the shunt contacts are staggered in the direction towards the mating shunt contact thereby to preload said pair of shunt contacts.

14. An electrical receptacle header, comprising:

an insulative housing comprising a pin receiving face, and a mounting face, the housing having a plurality of terminal receiving passageways therethrough;

a plurality of terminals positioned in said passageways, said terminals further comprising opposed contact portions which are adapted to deflect apart to receive therebetween a pin section in contacting relation, wherein the terminals are stamped and formed from a flat sheet of material including a forked contact section forming two contact arms, the arms being twisted about their length to form planar contact surfaces facing one another;

a first shunt contact member being positioned on one of said opposed contact portions of at least one of said terminals, and being profiled as a lateral extension, and a second shunt contact member, commoned to another one of said plurality of terminals, and extending into laterally overlapping relation with said first shunt contact member; whereby when the receptacle connector is disconnected from a mating pin connector, the first and second shunt contact members are engaged, electrically interconnecting associated contact members, and when the pin contact of the mating pin connector is inserted into the opposed contact portions, the first and second shunt contact members are disconnected.

15. The electrical receptacle header of claim 14, wherein the first shunt contacts on selected terminal, includes an extension portion extending laterally from one of the arms in the plane of the sheet material.

16. The electrical receptacle of claim 14, wherein the second shunt member is also comprised of a lateral extension from one of said opposed contact portions.

17. The receptacle header of claim 14, wherein the housing has lateral wall portions intermediate to laterally adjacent passageways, the lateral wall portions profiled to provide a communications between passageways of said terminals having said shunt contact members.

18. The receptacle header of claim 14, wherein a pin receiving portion of each terminal is located proximate said pin receiving face, and a conductor contacting section of each terminal is located proximate said mounting face, the shunt contact members extending from the terminal pin receiving portions.

19. The receptacle header of claim 17, wherein the shunt contact members are profiled as flag terminal portions extending integrally from their respective said terminal pin receiving portions.

20. The receptacle header of claim 19, wherein the flat terminal portion is stepped towards said opposed contact portion.

* * * * *

UNITED STATES PATENT AND TRADEMARK OFFICE

CERTIFICATE OF CORRECTION

PATENT NO. : 5,456,612

DATED : October 10, 1995

INVENTOR(S) : Johannes M.P.A. van Grunsven and Johannes W.A.J. van Lokven

It is certified that error appears in the above-identified patent and that said Letters Patent is hereby corrected as shown below:

On title page, item [30] second line the filing date is corrected to read:

March 9, 1992

Signed and Sealed this

Tenth Day of September, 1996

*Attest:*

Bruce Lehman

BRUCE LEHMAN

*Attesting Officer*

*Commissioner of Patents and Trademarks*